US010766758B2

(12) United States Patent
Blyth

(10) Patent No.: US 10,766,758 B2
(45) Date of Patent: Sep. 8, 2020

(54) ELECTRONIC FUEL MANAGEMENT CONTROL AND ACCOUNTING SYSTEM AND DEVICES

(71) Applicant: John Randolph Blyth, Tallahassee, FL (US)

(72) Inventor: John Randolph Blyth, Tallahassee, FL (US)

( * ) Notice: Subject to any disclaimer, the term of this patent is extended or adjusted under 35 U.S.C. 154(b) by 0 days.

(21) Appl. No.: 15/423,014

(22) Filed: Feb. 2, 2017

(65) Prior Publication Data

US 2017/0247241 A1 Aug. 31, 2017

Related U.S. Application Data

(60) Provisional application No. 62/301,384, filed on Feb. 29, 2016.

(51) Int. Cl.

| | |
|---|---|
| ***B67D 7/14*** | (2010.01) |
| ***B67D 7/16*** | (2010.01) |
| ***B67D 7/04*** | (2010.01) |
| ***B67D 7/34*** | (2010.01) |
| ***G07F 13/02*** | (2006.01) |

(52) U.S. Cl.

CPC ..... *B67D 7/145* (2013.01); *B67D 7/04* (2013.01); *B67D 7/16* (2013.01); *B67D 7/348* (2013.01); *G07F 13/025* (2013.01)

(58) Field of Classification Search

CPC . B67D 7/145; B67D 7/04; B67D 7/16; B67D 7/348; G07F 13/025

USPC ..... 700/231–244

See application file for complete search history.

(56) References Cited

U.S. PATENT DOCUMENTS

| | | | | |
|---|---|---|---|---|
| 4,410,949 | A * | 10/1983 | Huellinghorst | G06Q 50/06 705/413 |
| 5,109,347 | A * | 4/1992 | Quick, Jr. | G05D 11/132 222/134 |
| 5,586,050 | A * | 12/1996 | Makel | B67D 7/08 702/51 |
| 5,602,745 | A | 2/1997 | Atchley et al. | |
| 5,831,861 | A | 11/1998 | Warn et al. | |
| 6,360,138 | B1 | 3/2002 | Coppola et al. | |

(Continued)

FOREIGN PATENT DOCUMENTS

WO 2008141456 A1 11/2008

*Primary Examiner* — Michael Collins

(74) *Attorney, Agent, or Firm* — Marin Patents LP; Gustavo Marin

(57) ABSTRACT

In some embodiments, an electronic fuel management control and accounting system may include: a server having a management logic in a memory and executable by a processor; a client device having an interface logic in a memory and executable by a processor; and a dispenser control device communicatively coupled to a material providing system to control dispensing of a material from the material providing system. A dispensing logic may be stored in a memory of the dispenser control device and executable by a processor of the dispenser control device. The dispensing logic may communicate with the management logic of the server via the interface logic of the client device thereby allowing the management logic to control dispensing of the material from the material providing system. The system may enable any number of client devices, such as cell phones, to instantly provide access to the material providing system.

13 Claims, 9 Drawing Sheets

(56) References Cited

U.S. PATENT DOCUMENTS 6,442,448 B1 8/2002 Finley et al.
6,535,726 B1 3/2003 Johnson
6,546,314 B1 * 4/2003 Carr ..... B67D 7/222 700/236
6,820,041 B2 * 11/2004 Royal, Jr. ..... G07F 13/025 700/231
8,285,506 B2 10/2012 Oldham et al.
8,438,064 B2 5/2013 Berrio et al.
8,666,542 B2 * 3/2014 Durham ..... F02D 41/26 700/236
8,954,189 B2 * 2/2015 Zimmerman ..... G06Q 10/08 700/213
9,087,427 B2 * 7/2015 Weston ..... G06Q 20/20
10,210,696 B2 2/2019 Bretthauer
2003/0028285 A1 * 2/2003 Zura ..... G06Q 10/08 700/241
2003/0195653 A1 * 10/2003 Lewis ..... F02D 41/2493 700/236
2007/0156311 A1 7/2007 Elcock et al.
2009/0005016 A1 1/2009 Eng et al.
2009/0259590 A1 * 10/2009 Carapelli ..... G07F 7/025 705/44
2010/0023162 A1 * 1/2010 Gresak ..... G07F 13/025 700/241
2011/0195701 A1 8/2011 Cook et al.
2012/0043889 A1 * 2/2012 Recker ..... H05B 47/19 315/86
2012/0191242 A1 * 7/2012 Outwater ..... B60L 53/65 700/236
2012/0221152 A1 * 8/2012 Portocalis ..... G01F 15/02 700/283
2012/0297476 A1 11/2012 Zeljkovic et al.
2013/0035788 A1 2/2013 Divelbiss et al.
2013/0232019 A1 * 9/2013 Frieden ..... G06Q 20/204 705/17
2013/0246171 A1 9/2013 Carapelli
2014/0049365 A1 2/2014 Ahearn et al.
2014/0100692 A1 * 4/2014 Chittenden, Jr. ..... G07F 15/001 700/236
2014/0207277 A1 7/2014 Broome
2014/0299222 A1 10/2014 Williams et al.
2015/0085602 A1 3/2015 Lebedev et al.
2015/0302408 A1 * 10/2015 Weston ..... G06Q 20/20 705/64
2016/0182144 A1 * 6/2016 Stout ..... H04B 7/26 455/66.1
2016/0221816 A1 * 8/2016 Pollock ..... B67D 7/348
2017/0083988 A1 * 3/2017 Butsch ..... G06Q 20/204
2017/0313571 A1 * 11/2017 Zamora ..... B67D 7/04

* cited by examiner

ELECTRONIC FUEL MANAGEMENT CONTROL AND ACCOUNTING SYSTEM AND DEVICES

CROSS REFERENCE TO RELATED APPLICATIONS

This application claims priority to and the benefit of the filing date of U.S. Provisional Application No. 62/301,384, filed on Feb. 29, 2016, entitled "Electronic Fuel Management Control and Accounting System", which is hereby incorporated by reference in its entirety.

FIELD OF THE INVENTION

This patent specification relates to the field of fuel management and control systems. More specifically, this patent specification relates to a fuel management and control system configured to control a fuel dispenser and to provide information describing the amount of fuel dispensed.

BACKGROUND

Fuel management systems have existed for many decades in various iterations. One such common and typical example consists of a large electronic control unit comprised of a computer based control system, a means for the user to input vehicle and personnel data, such as through a keypad and a visual feedback device which may be an alphanumeric or graphical display of various designs. The computer based control system sends power or control signals to the dispenser(s) via cabling, usually encased within conduit, and receives the quantity of fuel dispensed back via cabling usually encased within conduit. The entire control system, comprised of the aforementioned elements, is contained in an upright, user accessible cabinet, mounted on the fuel island in close proximity to the dispensers being controlled. These have worked well for fuel islands with varying numbers of dispensers to control.

These fuel island mounted systems tend to be large by the necessity to allow for user interface and interaction and local computer control making the local logic decisions of vehicle validity and other user input data along with local storage of completed transactions as well as control of the fuel dispensers. They are also designed for expansion so as to control a multiplicity of dispensers. However, many fuel dispensing locations are often limited comprising a single tank and dispenser. Most fuel management systems, designed for these smaller fuel locations, are units with fewer features in an attempt to control costs to make them more attractive to the end user. However these attempts, while aiding in that goal, still consist of the same basic configuration—a large island mounted computer based control system, utilizing electronic inputs and displays, pump controls housed in a cabinet and locally authorized fueling permission, data storage and final transaction storage.

Therefore a need exists for a novel fuel management and control systems. There is also a need for novel fuel management and control systems which do not have the same hardware and installation requirements as currently available fuel island mounted systems. Finally, a need exists for novel fuel management and control systems for smaller, generally single hose systems that while also applicable for multiple hoses, provide the same or similar capabilities of larger systems while also eliminating the cost and complexities of the computer hardware and related devices.

BRIEF SUMMARY OF THE INVENTION

An electronic fuel management control and accounting system is provided which may operate as a seamless, fully capable fuel access, control and management system. The system may enable any number of client devices, such as cell phones, to instantly provide access to a material providing system along with the ability to instantly authorize or de-authorize access to the material providing system without having to use or send traditional credit cards to users through the mail system.

In some embodiments, an electronic fuel management control and accounting system may include: a server having a management logic in a memory and executable by a processor; a client device having an interface logic in a memory and executable by a processor; and a dispenser control device communicatively coupled to a material providing system to control dispensing of a material from the material providing system. A dispensing logic may be stored in a memory of the dispenser control device and executable by a processor of the dispenser control device. The dispensing logic may communicate with the management logic of the server via the interface logic of the client device thereby allowing the management logic to control dispensing of the material from the material providing system.

According to one aspect consistent with the principles of the invention, a dispenser control device is provided. The dispenser control device may be communicatively coupled to a material providing system for dispensing of a material to enable the dispenser control device to control the dispensing of material from the material providing system. In some embodiments, the dispenser control device may include a dispensing logic in a memory and executable by a processor; a radio module which enables wireless communication with a client device; a pump control relay communicatively coupled to a material motivator of the material providing system; and a pulser interface for receiving data from a pulser communicatively coupled to the material providing system that describes the quantity of material dispensed by the material providing system.

In further embodiments, the dispenser control device may enable the complete elimination of the traditional large fuel island mounted user terminal (displays, keypads, computers, connectors and complex installation), to a small simplistic unit easily installed on a material providing system in a few minutes, thereby reducing the cost of acquisition and ownership of a material providing system to a small fraction of the traditional cost of fuel control systems.

In still further embodiments, the dispenser control device may provide a small, simple, cost effective single, dual, or more hose control unit that universally controls any material providing system that may communicate with client devices to enable the client devices to function as hand held authorization devices to control the dispensing of a material from the material providing system.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
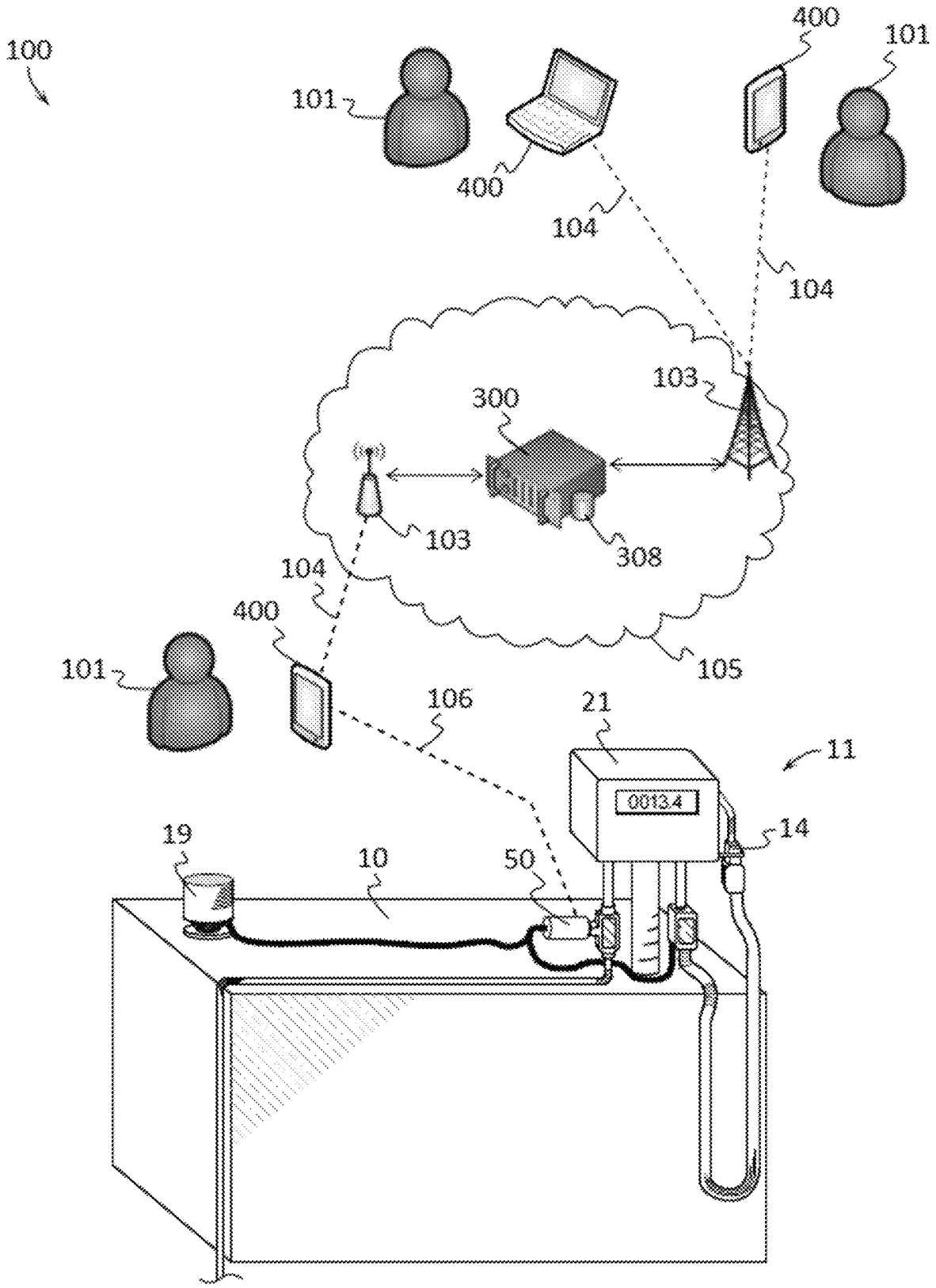
FIG. 1 depicts an illustrative example of some of the components and computer implemented methods which may be found in a electronic fuel management control and accounting system according to various embodiments described herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

Definitions

As used herein, the term "computer" refers to a machine, apparatus, or device that is capable of accepting and performing logic operations from software code. The term "application", "software", "software code" or "computer software" refers to any set of instructions operable to cause a computer to perform an operation. Software code may be operated on by a "rules engine" or processor. Thus, the methods and systems of the present invention may be performed by a computer or computing device having a processor based on instructions received by computer applications and software.

The term "client device" as used herein is a type of computer or computing device comprising circuitry and configured to generally perform functions such as recording audio, photos, and videos; displaying or reproducing audio, photos, and videos; storing, retrieving, or manipulation of electronic data; providing electrical communications and network connectivity; or any other similar function. Non-limiting examples of electronic devices include: personal computers (PCs), workstations, laptops, tablet PCs including the iPad, cell phones including iOS phones made by Apple Inc., Android OS phones, Microsoft OS phones, Blackberry phones, digital music players, or any electronic device capable of running computer software and displaying information to a user, memory cards, other memory storage devices, digital cameras, external battery packs, external charging devices, and the like. Certain types of electronic devices which are portable and easily carried by a person from one location to another may sometimes be referred to as a "portable electronic device" or "portable device". Some non-limiting examples of portable devices include: cell phones, smartphones, tablet computers, laptop computers, wearable computers such as Apple Watch, other smartwatches, Fitbit, other wearable fitness trackers, Google Glasses, and the like.

The term "computer readable medium" as used herein refers to any medium that participates in providing instructions to the processor for execution. A computer readable medium may take many forms, including but not limited to, non-volatile media, volatile media, and transmission media. Non-volatile media includes, for example, optical, magnetic disks, and magneto-optical disks, such as the hard disk or the removable media drive. Volatile media includes dynamic memory, such as the main memory. Transmission media includes coaxial cables, copper wire and fiber optics, including the wires that make up the bus. Transmission media may also take the form of acoustic or light waves, such as those generated during radio wave and infrared data communications.

As used herein the term "data network" or "network" shall mean an infrastructure capable of connecting two or more computers such as client devices either using wires or wirelessly allowing them to transmit and receive data. A "wireless electronic connection" may be a type of network between two electronic devices. Non-limiting examples of data networks may include the internet or wireless networks or (i.e. a "wireless network") which may include Wifi and cellular networks. For example, a network may include a local area network (LAN), a wide area network (WAN) (e.g., the Internet), a mobile relay network, a metropolitan area network (MAN), an ad hoc network, a telephone network (e.g., a Public Switched Telephone Network (PSTN)), a cellular network, or a voice-over-IP (VoW) network.

As used herein, the term "database" shall generally mean a digital collection of data or information. The present invention uses novel methods and processes to store, link, and modify information such digital images and videos and user profile information. For the purposes of the present disclosure, a database may be stored on a remote server and accessed by a client device through the internet (i.e., the database is in the cloud) or alternatively in some embodiments the database may be stored on the client device or remote computer itself (i.e., local storage). A "data store" as used herein may contain or comprise a database (i.e. information and data from a database may be recorded into a medium on a data store).

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New fuel management and control systems are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. As perhaps best shown by FIG. 1, an illustrative example of some of the physical components which may comprise a electronic fuel management control and accounting system ("the system") 100 according to some embodiments is presented. The system 100 is configured to facilitate the transfer of data and information between one or more access points 103, client devices 400, dispenser control devices 50, and servers 300 over a data network 105. In some embodiments, each client device 400 and dispenser control device 50 may send data to and receive data from the data network 105 through a network connection 104 with an access point 103. In preferred embodiments and as shown in FIG. 1, a dispenser control device 50 may have a wireless electronic connection 106 with a client device 400, and the dispenser control device 50 may access the data network 105 through a network connection 104 via the wireless electronic connection 106. Each dispenser control device 50 may be in communication with a material providing system 11 configured to provide fluid or other bulk product external hard media. A data store 308 accessible by the server 300 may contain one or more databases.

The data may comprise any information pertinent to the dispensing of material from a material providing system 11, including information on or describing one or more users 101, information on or describing one or more seller entities, information on or describing one or more buyer entities, information on or describing the amount of material dispensed by the material providing system 11, or any other information.

In this example, the system 100 comprises at least one client device 400 (but preferably more than two client devices 400) configured to be operated by one or more users 101. Client devices 400 can be mobile devices, such as laptops, tablet computers, personal digital assistants, smart phones, and the like, that are equipped with a wireless network interface capable of sending data to one or more servers 300 with access to one or more data stores 308 over a network 105 such as a wireless local area network (WLAN). Additionally, client devices 400 can be fixed devices, such as desktops, workstations, and the like, that are equipped with a wireless or wired network interface capable of sending data to one or more servers 300 with access to one or more data stores 308 over a wireless or wired local area network 105. The present invention may be implemented with at least one client device 400 and/or server 300 programmed to perform one or more of the steps described herein. In some embodiments, more than one client device 400 and/or server 300 may be used, with each being programmed to carry out one or more steps of a method or process described herein.

In some embodiments, the system 100 may comprise one or more dispenser control devices 50 and one or more material providing systems 11. Each dispenser control device 50 may be in wired or wireless electronic communication with a material providing system 11 and be configured to control one or more functions of a material providing system 11. Generally a material providing system 11 may comprise any device or system configured to provide fluid or other bulk product external hard media. Example, material providing systems 11 include fuel or gas pumps, air pumps, and ice dispensers. For purposes of illustration, the system 100 will be described using a fuel dispensing type material providing system 11, although one skilled in the art will recognized that the system and methods described herein may be used with any gas, liquid, or solid material dispensing systems. In preferred embodiments, data may be communicated between a dispenser control device 50, client device 400, and/or server 300, to enable the system 100 to provide accounting, authorization, and management functions of fluid or other bulk product external hard media that may be dispensed by the material providing system 11 to which a dispenser control device 50 is in electronic communication with.

Referring now to FIGS. 1-4, in this and some embodiments, the system 100 may comprise: a client device 400, such as a smart phone, laptop computer, tablet computer, desktop computer, or other work station, which may be used by a user 101 to initiate transactions for the dispensing of a material from a material providing system 11; a cloud based server 300 which may provide data management and purchasing authorizations; and a dispenser control device 50, which may enable a material providing system 11 to dispense a material and also provide information from the material providing system 11.

In a practical example, a user 101 may park a vehicle next to the material providing system 11, inserts the fuel nozzle 14 of the material providing system 11 into the vehicle, and utilizes their own personal client device 400 to provide information to the system 100 such as the vehicle number, odometer and any other information as may be needed or required. The client device 400 may transmit, via a cellular, WiFi, Bluetooth or other suitable data network connection 104, the information to a server 300 running software routines that may check a system database 110 database and/or other database to query for proper authorization at which point the server 300 may return to the client device 400 an authorization permission. The client device 400 and/or server 300 may send an authentication to the dispenser control device 50 via the wireless electronic connection 106 allowing the dispenser control device 50 to turn on power to the material providing system 11 or otherwise enable the material providing system 11 to dispense its respective material.

During fueling, the pulser 13, or other material quantity sensing device, may provide data describing the quantity of material dispensed to the dispenser control device 50. Typically, a pulser 13 is associated with a flow meter for generating pulser data indicative of a volume of fluid or material delivered through the flow meter. When fueling is complete the dispenser control device 50 may return the final quantity to the client device 400 and/or to the server 300. Preferably, data from the pulser 13 may be stored in a system database 110 accessible to the server and/or one more client devices 400. Optionally, the client device 400, may provide the final transaction information to the server 300 where it may be stored in the system database 110. One or more users 101 may access the transaction data from the server 300 and/or database 110 via their respective client device 400 such as by the internet through a web browser running on a remote client device 400 located at the user's 101 local home, work, or other environment or in any location where web access is available.

In preferred embodiments, the system 100 may be implemented with a fuel island having both a fuel tank 10 and a material providing system 11 with a material motivator 21 or pump motor along with a dispensing hose 15 and attached dispensing fuel nozzle 14. Optionally, each material providing system 11 may be physically equipped with a mechanical or electronic quantity display 12. A dispenser control device 50, having a unique electronic signature identifier such as a serial number; may be in electronic communication with the material providing system 11, such as to the pulser 13 and/or other electronic control devices of the material providing system 11.

In some embodiments, a pulser 13 may be utilized for digital counting of fluid flow with connection preferably via an intrinsically safe data cable to the pulser interface 64 of the dispenser control device 50. In other embodiments, a standalone radio equipped pulser 13 with a wireless connection to the dispenser control device 50 may be used. In further preferred embodiments, a wire connection box 17 may be utilized to allow the dispenser control device 50, the material providing system 11 power conduit 16, and the material providing system 11 to be physically connected together and preferably for all field wiring to be housed in an explosion proof wire connection box 17 with adequate space for all wires to the interconnected.

A client device 400 with display and data input and output capability, such as may be provided via a touch screen type of I/O interface 404 (FIG. 6) or a physical keypad and display, may be in communication with the dispenser control device 50. Each client device 400 may be programmed with an application, such as an interface module 417 (FIG. 7), utilized for information input and data transfer between the dispenser control device 50 and a server 300. The server 300, likewise, may be programmed with appropriate software, such as a system management module 317 (FIG. 7), capable of exchanging data a network 105 with the client device 400 and a system database 110 (FIG. 7) to store authorized vehicle and personnel information and competed transactions. Optionally, one or more remote client devices 400, that may be located anywhere, may be in communication with the server 300 and may have network 105 access that allows the user 101 of the respective client device 400 to use a web browser or other application to access data from the server 300 and/or database 110 to produce reports and update vehicle and personnel records.

In preferred embodiments, the system 100 may be fully functional to operate as a seamless, fully capable fuel access, control and management system. For example, a user 101 may park a vehicle requiring fuel in proximity to the fuel tank 10 of a material providing system 11 having a dispenser control device 50. The user 101, may exit the vehicle and proceed to place the dispenser nozzle 14 into the vehicle fuel tank filler neck. For purposes of illustration and not to be in any way limiting, the following description will make reference to a fuel type material providing system 11 activation. However it will be appreciated that the system 100 is equally able to be practiced on any of the many varieties of dispensers and their respective activation methods. The material providing system 11 may have an automatic method that activates the enclosed material motivator 21 or pump motor circuits in the material providing system 11 or may require the user to turn a handle incorporated in the material providing system 11 to activate the material motivator 21 or pump motor circuits. Neither option has any material effect to the system 100 as all dispensers require an activation method of some sort. Further still, the generic material providing system 11 depicted is representative of smaller fuel dispensing systems and in no way limiting the ability of the present invention to control larger dispensing systems that may incorporate enclosed housings, material motivators 21 or pump motors, solenoids, displays, reset motors and other elements typical of larger dispensers. The user 101 may then utilize their client device 400 to initiate a transaction with the material providing system 11.

In some embodiments, an electronic fuel management control and accounting system 100 may comprise one or more client servers 300 and devices 400 which allow user 101 input with feedback and control of one or more material providing systems 11 in which each material providing system 11 is communicatively coupled to a dispenser control device 50. In further embodiments, the system 100 may utilize a dispenser control device 50 that works in conjunction with a material providing system 11 having a mounted pulser 13 for fuel quantity counting and having a wireless communications radio module which is able to communicate with ubiquitous client devices 400 such as cell phones, tablets, net books, notebooks, handheld PC or similar devices thereby allowing the client devices 400 to act as or provide the user interface of the system 100 for entering fueling data and transferring completed transactions to user accessible cloud based report generators.

In preferred embodiments, a hand held client device 400 may be carried by all system users 101 in which preferably each client device 400 comprises an interface module 417 that serves as a information conduit between the users 101 and the system 100. The interface module 417 allows the user 101 to enter appropriate vehicle and personnel information into the client device 400 thereby eliminating the large expensive user interface control systems typical of fueling systems. This data may be transmitted to a cloud based server 300 handling a multiplicity of customer users 101 which may verify the validity of the data and may transmit an acceptance/decline message back to the client device 400 in response to a fueling or other material dispensing request provided by the client device 400. The client device 400 in turn, may send an authorization message, preferably wirelessly, to the radio module 53 of the dispenser control device 50 through a wireless electronic connection 106. The dispenser control device 50 may comprise a digital electronic device incorporating a processor 51 that may interpret the signal status from the client device 400 and turns on power to the material providing system 11 that is communicatively coupled to the dispenser control device 50. The dispenser control device 50 may also be connected to a pulser 13, optionally the pulser 13 may be integral to the dispenser control device 50 and/or integral to the material providing system 11, which monitors the quantity of fuel or material dispensed and sends that data back to the client device 400. Upon completion of the fueling transaction, the client device 400 sends data describing the transaction back to the server 300. The server 300, while acting as the authorization point, may also provide a system owner's or system administrator's interface for generation of all reports, vehicle and personnel updates and database storage via a web interface.

In further embodiments, the system 100 may incorporate a pre-authorization mode for one or more client devices 400 thereby allowing the system owner or administrator to send an authorization for fueling to the client device 400 while the client device 400 is within network 105 range. Any dispenser control device 50 equipped fuel tank 10 and/or material providing system 11 located outside network 105 range would then be able to dispense fuel based on receiving the pre-authorization provided with the client device 400. The final transaction may remain resident in the client device 400 until such time as the client device 400 returns back to network 105 range and may then be provided to the server 300.

In still further embodiments, the system 100 may incorporate an optional additional pump control interface 63, pump control relay 62, pulser interface 64, and/or tank level probe 19 interface into the same electronic control device to allow control of an material providing system 11 located in close proximity to the first material providing system 11.

Figure 2:
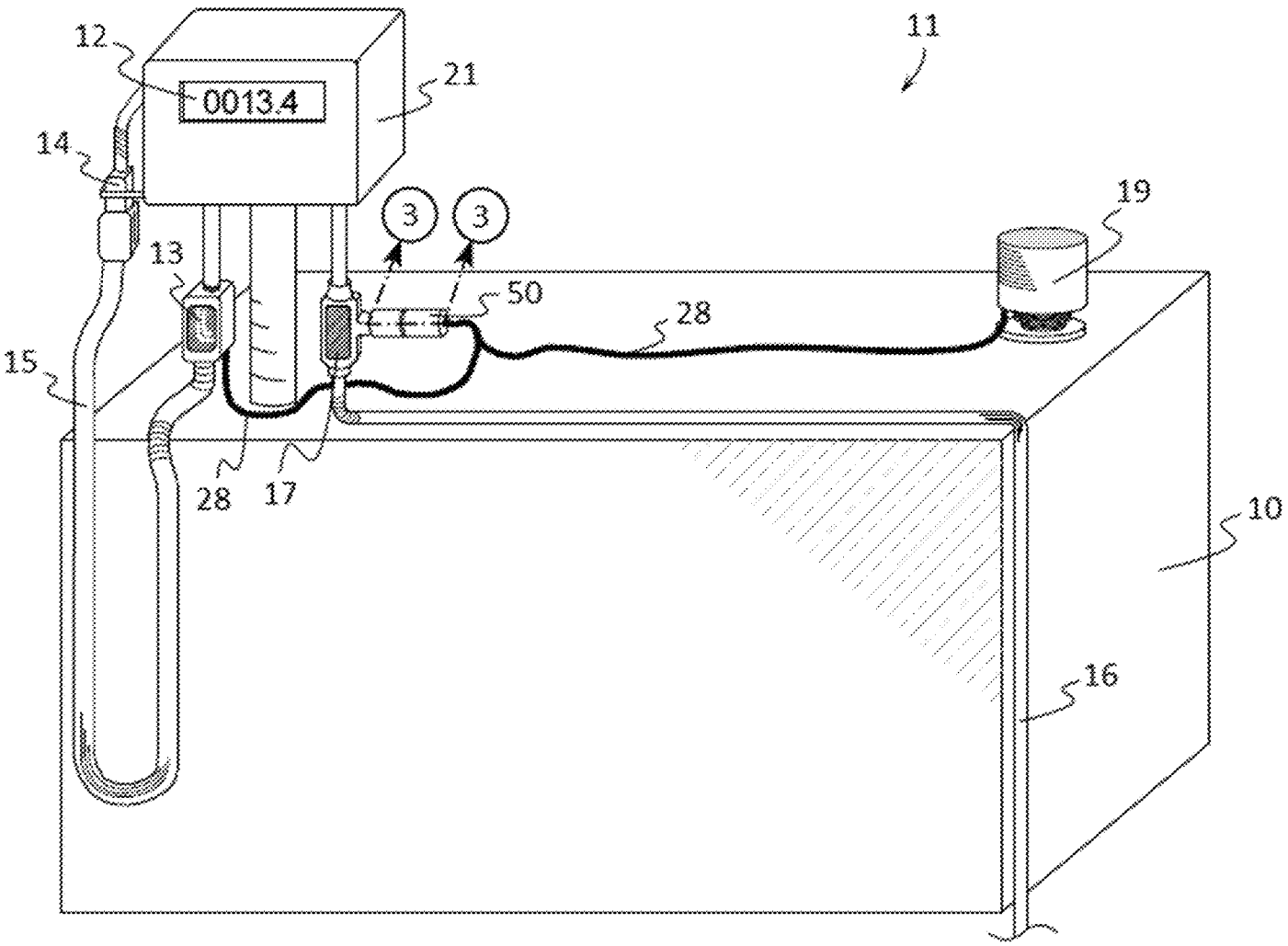
FIG. 2 illustrates a perspective view of an example of a material providing system and dispenser control device according to various embodiments described herein.

In some embodiments, the dispenser control device 50 may be in communication or interface to an optional external tank level probe 19 (FIGS. 1 and 2). A tank level probe 19 may be a tank level detection device that allows instant and continuous monitoring of the fluid level in the fuel tank 10 wherein data describing the level of material in the tank 10 accessed by the material providing system 11 can be transmitted back to the cloud based server 300 with each transaction preferably by the client device 400. Examples of tank level probes 19 include magnetic level gauges, magnetorestrictive level-sensing technologies, RF transmitter level-sensing technologies, radar level-sensing technologies, ultrasonic level-sensing technologies, magnetic switch level-sensing technologies, float switch level-sensing technologies, RF switch level-sensing technologies, vibrating fork level-sensing technologies, thermal dispersion level-sensing technologies, and seal pot level-sensing technologies. Fluid levels allow the tank 10 owner the ability to monitor the fluid level and place refill orders.

Figure 6:
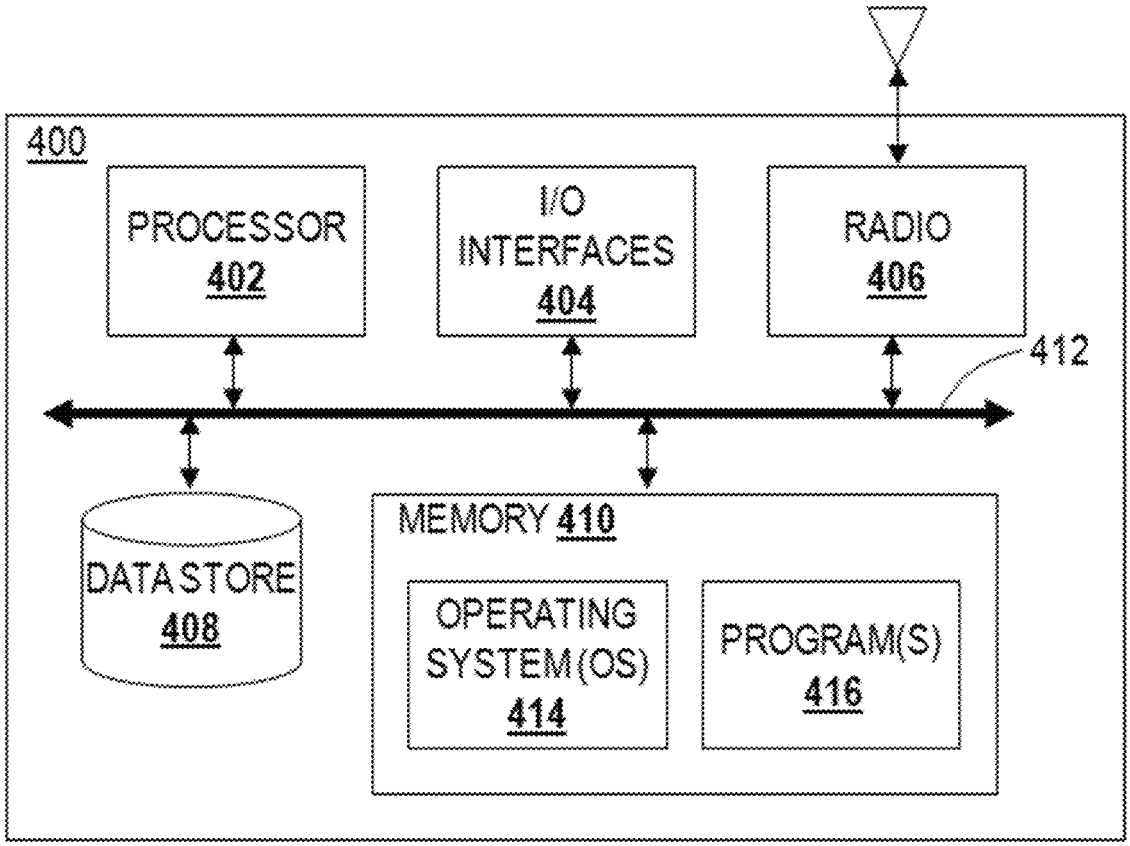
FIG. 6 shows a block diagram showing an example of a client device which may be used by the system as described in various embodiments herein.
Figure 7:
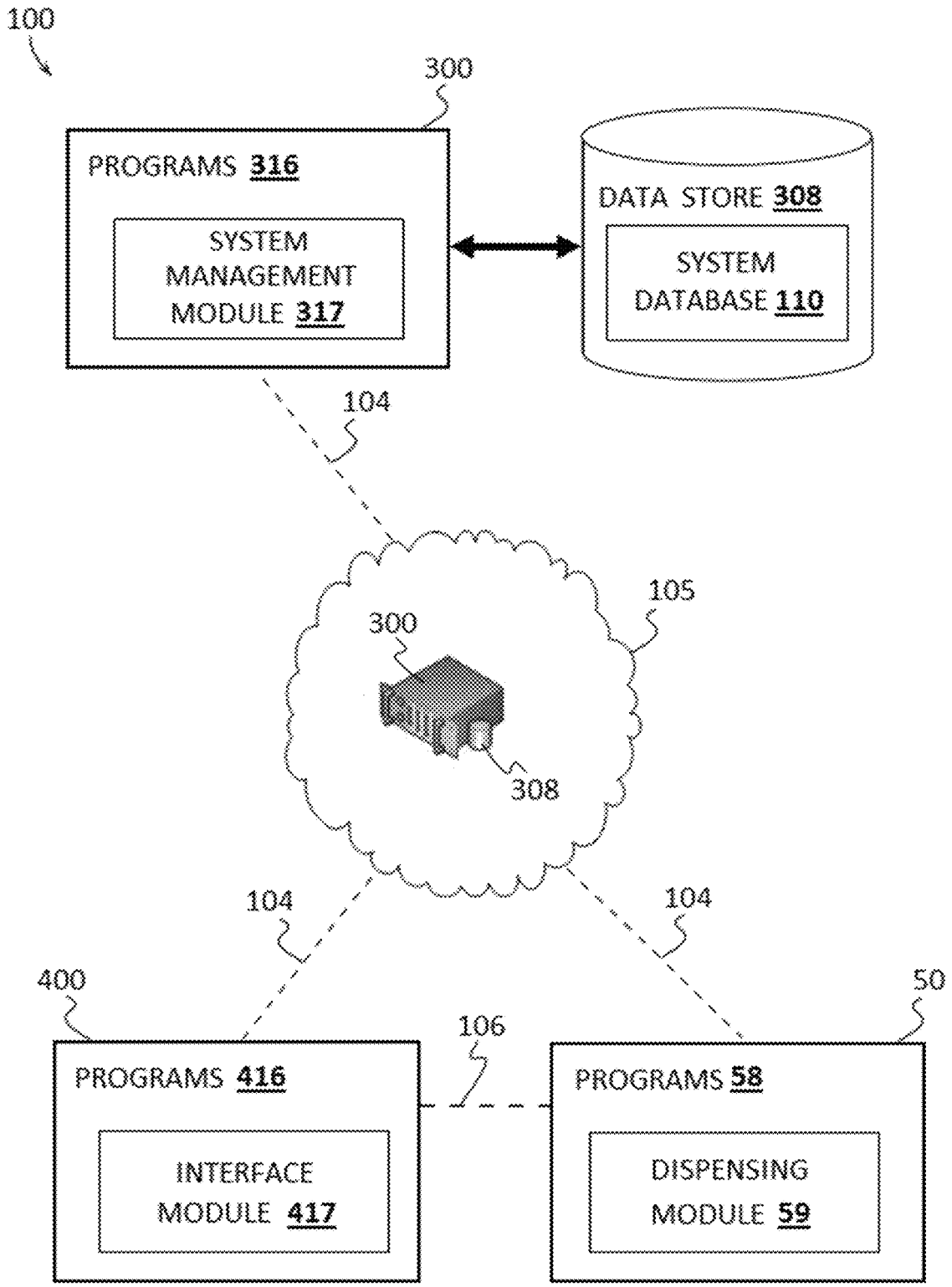
FIG. 7 depicts a block diagram illustrating some modules of an electronic fuel management control and accounting system in which each module may function as software rules engine according to various embodiments described herein.

The tank level probe 19 may be connected to a tank level probe interface 65 of the dispenser control device 50 via an intrinsically safe cable 28 that provides both power to the probe and receives level data back to the dispenser control device 50. Alternatively, the dispenser control device 50 may be in wireless communication with an optional external tank level probe 19. The dispenser control device 50 may be programmed to periodically monitor the tank probe 19, store the level readings, and transmit that stored data to the server 300 (FIGS. 1, 5, and 7) where the data can be retrieved via one or more client devices 400 (FIGS. 1, 6, and 7). The transmitted data may be sent concurrently with any current fuel transaction via the client device 400. The system management module 317 (FIG. 7), dispensing module 59 (FIG. 7), and/or interface module 417 (FIG. 7) can produce reports as necessary to show current fuel levels and reorder points. In further embodiments, the tank level probe 19 provides data describing the level of material in a tank 10 accessed by the material providing system 11 to the dispensing module 59.

Figure 3:
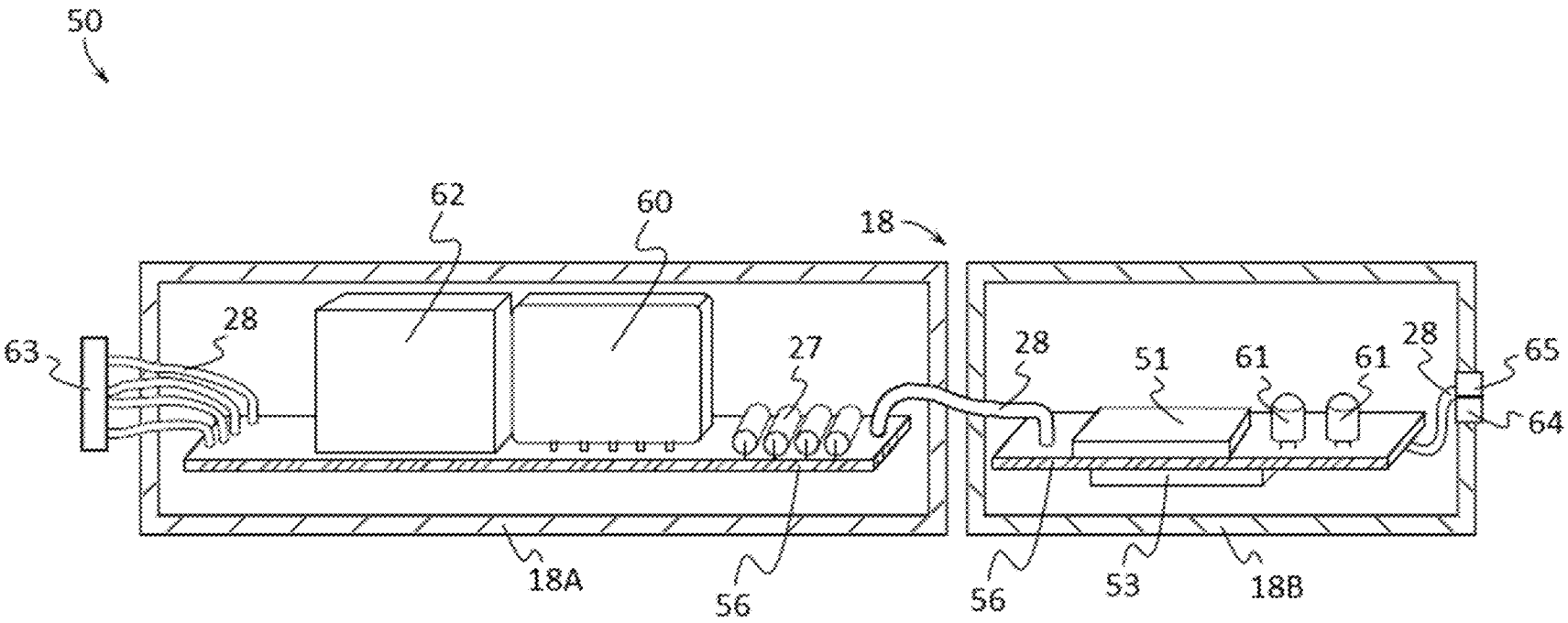
FIG. 3 shows a sectional, through line 3-3 shown in FIG. 2, elevation view of an example of a dispenser control device according to various embodiments described herein.

FIG. 3 shows a sectional, through line 3-3 shown in FIG. 2, elevation view of an example of a dispenser control device 50 according to various embodiments described herein. In some embodiments, a dispenser control device 50 may comprise one or more housings 18 which may provide a protective case or covering for one or more components of the dispenser control device 50. In preferred embodiments, the dispenser control device 50 may comprise a first housing 18A and a second housing 18B with a pump control relay 62, pump control interface 63, intrinsically safe power source 60, and intrinsic safety components 27 communicatively coupled via a local interface 56 in the first housing 18A and a processor 51, radio module 53, indicator elements 61, and pulser interface 64 also communicatively coupled via a local interface 56 in the second housing 18B. An intrinsically safe cable 28 may communicatively couple the components of the first housing 18A and a second housing 18B. However, the present hardware design of the dispenser control device 50 of FIG. 3 is recognized by anyone skilled in the art as one of many possible configurations designed to house an electronic device in an explosion proof housing. The dispenser control device 50 may incorporate a simple metal tubular first housing 18A, although other materials and shapes may be used, that preferably may be easily screwed or otherwise coupled to the into the material providing system 11, yet provides adequate space for the intended internal components along with a clear plastic second housing 18B with one or more light emitting diode type (LED) indicator elements 61 to provide limited user 101 feedback as to the status of the hardware. The metal first housing 18A, upon completion of assembly, may be potted with an appropriate compound to seal it from outside explosive vapors which might be present and to seal it from the clear plastic second housing 18B which is an intrinsically safe housing.

Figure 4:
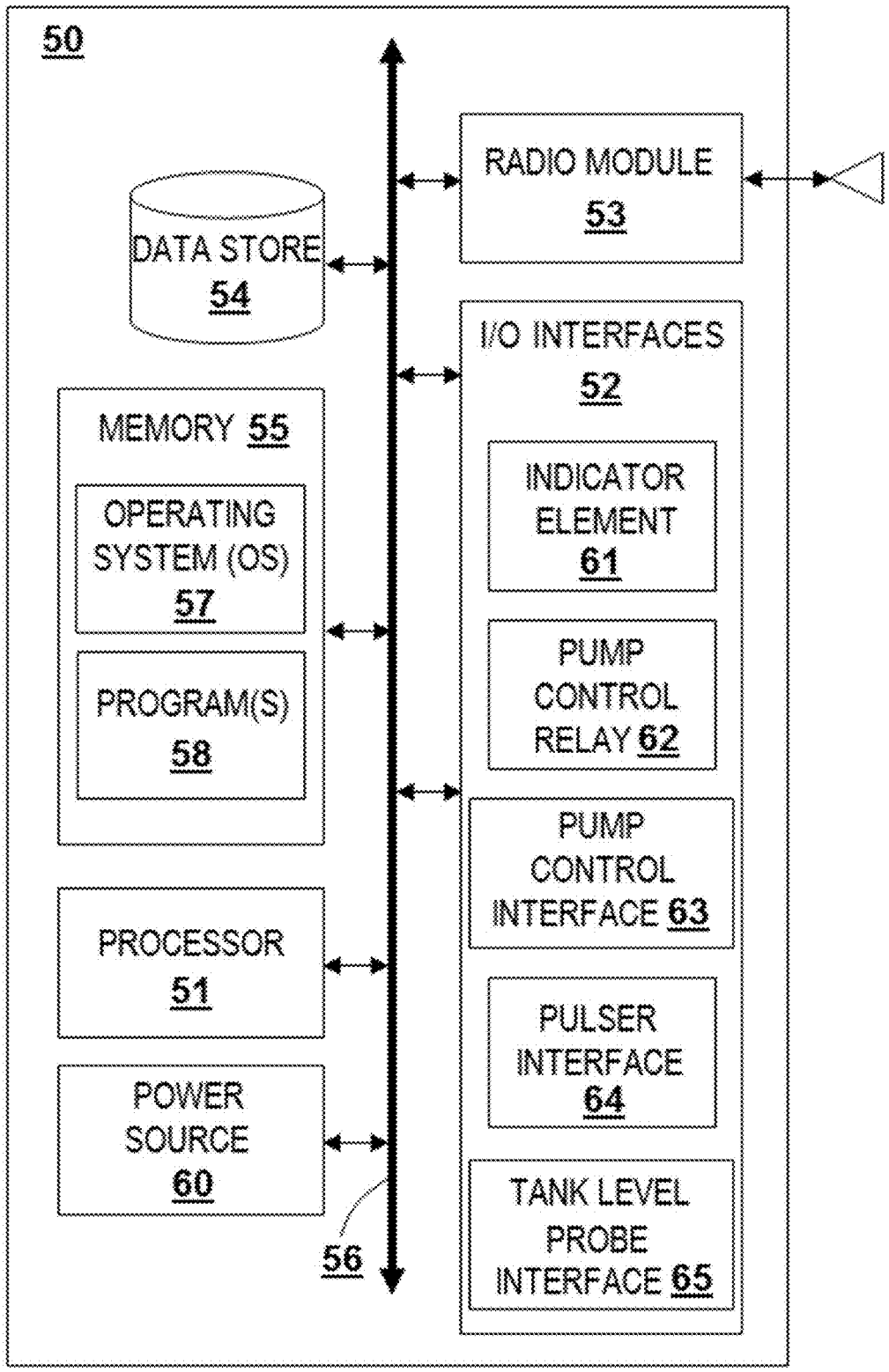
FIG. 4 depicts a block diagram showing an example of a dispenser control device which may be used by the system as described in various embodiments herein.

FIG. 4 depicts a block diagram showing an example of a dispenser control device 50 which may be used by the system 100 as described in various embodiments herein. In this and some embodiments, the components of the dispenser control device 50 may be encased or covered in a single, preferably explosion proof, housing 18. It should be appreciated by those of ordinary skill in the art that FIG. 4 depicts the dispenser control device 50 in an oversimplified manner, and a practical embodiment may include additional components or elements and suitably configured processing logic to support known or conventional operating features that are not described in detail herein.

In some embodiments and in the present example, the dispenser control device 50 can be a digital device that, in terms of hardware architecture, may generally include a processor 51, input/output (I/O) interfaces 52, radio module 53, data store 54, memory 55, and a power source 60. The I/O interfaces 52 may include one or more indicator elements 61, pump control relays 62, pump control interfaces 63, pulser interfaces 64, and tank level probe interfaces 65. The components and elements (51, 52, 53, 54, 55, 57, 58, 60, 61, 62, 63, 64, 65) are communicatively coupled via a local interface 56.

The local interface 56 can be, for example but not limited to, one or more, circuit boards, buses or other wired or wireless connections, as is known in the art. The local interface 56 can have additional elements, which are omitted for simplicity, such as controllers, buffers (caches), drivers, repeaters, and receivers, among many others, to enable communications. Further, the local interface 56 may include address, control, and/or data connections to enable appropriate communications among the aforementioned components.

The processor 51 is a hardware device for executing software instructions. The processor 51 can be any custom made or commercially available processor, a central processing unit (CPU), an auxiliary processor among several processors associated with the processing unit 51, a semiconductor-based microprocessor (in the form of a microchip or chip set), or generally any device for executing software instructions. When the processing unit 51 is in operation, the processor 51 is configured to execute software stored within the memory 55, to communicate data to and from the memory 55, and to generally control operations of the dispenser control device 50 pursuant to the software instructions.

The I/O interfaces 52 can be used to receive and/or output information from the dispenser control device 50. The I/O interfaces 52 can also include, for example, a serial port, a parallel port, a small computer system interface (SCSI), an infrared (IR) interface, a radio frequency (RF) interface, a universal serial bus (USB) interface, one or more sensors, and the like.

An optional radio module 53 enables wireless electronic connection 106 (FIGS. 1 and 7) or communication to an external access device, such as a client device 400, optionally network 105, and optionally to the material providing system 11. In some embodiments, a radio module 53 may operate on a cellular band and may communicate with or receive a Subscriber Identity Module (SIM) card or other wireless network identifier. In further radio module 53 may operate on a WiFi and/or Bluetooth communication protocol. Any number of suitable wireless data communication protocols, techniques, or methodologies can be supported by the radio module 53, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Near-Field Communication (NFC); Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

The data store 54 may be used to store data. The data store 54 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 54 may incorporate electronic, magnetic, optical, and/or other types of storage media.

The memory 55 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 5 may incorporate electronic, magnetic, optical, and/or other types of storage media. Note that the memory 5 may have a distributed architecture, where various components are situated remotely from one another, but can be accessed by the processor 51. The software in memory 5 can include one or more software programs, each of which includes an ordered listing of executable instructions for implementing logical functions. In the example of FIG. 4, the software in the memory system 55 includes programs 58. The programs 58 may include various applications, add-ons, etc. configured to provide end user functionality with the dispenser control device 50. In a typical example, one or more of the programs 58 may control the functions of the dispenser control device 50 and preferably one or more functions of the material providing system 11.

In some embodiments, the dispenser control device 50 may optionally comprise a power source 60 which may provide electrical power to any component of the dispenser control device 50 that may require electrical power. Intrinsically safe power may be provided by the power source 60 which may convert incoming power from the dispenser power conduit 16 into a low voltage that is voltage and power limited, generally referred to as intrinsically safe in accordance with requirements as defined by ANSI/UL 913. In some embodiments, a power source 60 may comprise a power cord which may be coupled to a power conduit 16 (FIG. 2), kinetic or piezo electric battery charging device, a solar cell or photovoltaic cell, and/or inductive charging or wireless power receiver. In further embodiments, a power source 60 may comprise a battery, such as a lithium ion battery, nickel cadmium battery, alkaline battery, or any other suitable type of battery, a fuel cell, a capacitor, a super capacitor, or any other type of energy storing and/or electricity releasing device.

In some embodiments, one or more indicator elements 61 may be configured to apprise a user 101 of the status of the dispenser control device 50 and/or the status of the material providing system 11 such as if they are powered on and the like. To provide for information to a user, embodiments of an indicator element 61 can be visually implemented with one or more light emitting elements or other display device, e.g., a LED (light emitting diode) display or LCD (liquid crystal display) monitor, for displaying information. Other kinds of indicator element 61 devices can be used to provide for interaction with a user as well; for example, feedback provided to the user can be any form of sensory feedback, e.g., visual feedback, auditory feedback, or tactile feedback;

and input from the user can be received in any form, including acoustic, speech, or tactile input.

In some embodiments, the dispenser control device 50 may comprise a pump control relay 62 which may be configured to act as an electrically operated switch for operating a material motivator 21 or pump of the material providing system 11. The pump control relay 62 may enable the dispenser control device 50 to control the material motivator 21 and therefore control the dispensing of a material motivated or propelled by the material motivator 21, such as fuel, from the material providing system 11.

In some embodiments, the dispenser control device 50 may comprise a pump control interface 63 which may comprise a wired connection for providing electronic communication between the dispenser control device 50 and one or more components of the material providing system 11. In other embodiments, the dispenser control device 50 may be in electronic communication with a pump or other material motivating device of the material providing system 11 via a pump control interface 63. In still other embodiments, a pump control interface 63 may enable wireless communication with a pump or other material motivating device of the material providing system 11 optionally via the radio module 53.

In some embodiments, the dispenser control device 50 may comprise a pulser interface 64 which may comprise a wired connection for providing electronic communication between the dispenser control device 50 and a pulser 13 coupled to the material providing system 11. Generally, a pulser interface 64 may receive data from a pulser 13 communicatively coupled to the material providing system 11 that describes the quantity of material dispensed by the material providing system 11. In some embodiments, the system 100 may comprise a pulser 13 which may be coupled to the material providing system 11 such as to the dispensing hose 15 (FIG. 2). In other embodiments, the dispenser control device 50 may be in electronic communication with a pulser 13 of the material providing system 11 via a pulser interface 64. In still other embodiments, a pulser interface 64 may enable wireless communication with a pulser 13 which may be coupled to the material providing system 11 optionally via the radio module 53.

In some embodiments, the dispenser control device 50 may comprise a tank level probe interface 65 which may comprise a wired connection for providing electronic communication between the dispenser control device 50 and a tank level probe 19 coupled to the tank 10 of the material providing system 11. In other embodiments, a tank level probe interface 65 may enable wireless communication with a tank level probe 19 coupled to the tank 10 of the material providing system 11 optionally via the radio module 53.

In preferred embodiments, the dispenser control device 50 may be configured to provide the actual pump on/off functions to the attached material providing system 11 dispenser. via a pump control relay 62. The pump control relay 62 may be electronically controlled by the processor 51 optionally through an intrinsically safe control cable 28. The processor 51 may be in communication with an internal non-volatile memory 55 to store software codes for program execution and data storage to set variable operating parameters and to store data about the current transaction and sufficient memory to hold prior transactions acting as a secondary backup.

Figure 5:
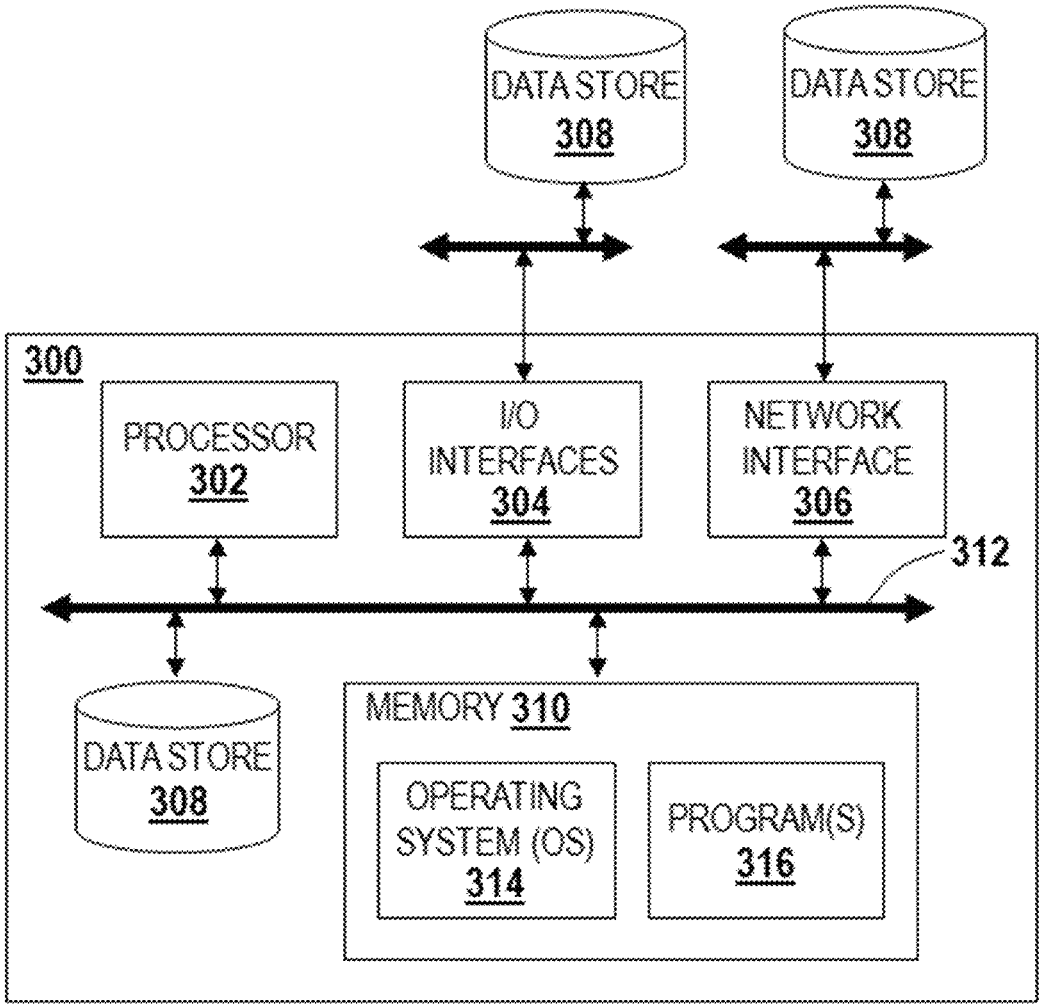
FIG. 5 illustrates a block diagram showing an example of a server which may be used by the system as described in various embodiments herein.

Referring now to FIG. 5, in an exemplary embodiment, a block diagram illustrates a server 300 of which one or more may be used in the system 100 or standalone and which may be a type of computing platform. The server 300 may be a digital computer that, in terms of hardware architecture, generally includes a processor 302, input/output (I/O) interfaces 304, a network interface 306, a data store 308, and memory 310. It should be appreciated by those of ordinary skill in the art that FIG. 5 depicts the server 300 in an oversimplified manner, and a practical embodiment may include additional components and suitably configured processing logic to support known or conventional operating features that are not described in detail herein. The components (302, 304, 306, 308, and 310) are communicatively coupled via a local interface 312. The local interface 312 may be, for example but not limited to, one or more buses or other wired or wireless connections, as is known in the art. The local interface 312 may have additional elements, which are omitted for simplicity, such as controllers, buffers (caches), drivers, repeaters, and receivers, among many others, to enable communications. Further, the local interface 312 may include address, control, and/or data connections to enable appropriate communications among the aforementioned components.

The processor 302 is a hardware device for executing software instructions. The processor 302 may be any custom made or commercially available processor, a central processing unit (CPU), an auxiliary processor among several processors associated with the server 300, a semiconductor-based microprocessor (in the form of a microchip or chip set), or generally any device for executing software instructions. When the server 300 is in operation, the processor 302 is configured to execute software stored within the memory 310, to communicate data to and from the memory 310, and to generally control operations of the server 300 pursuant to the software instructions. The I/O interfaces 304 may be used to receive user input from and/or for providing system output to one or more devices or components. User input may be provided via, for example, a keyboard, touch pad, and/or a mouse. System output may be provided via a display device and a printer (not shown). I/O interfaces 304 may include, for example, a serial port, a parallel port, a small computer system interface (SCSI), a serial ATA (SATA), a fibre channel, Infiniband, iSCSI, a PCI Express interface (PCI-x), an infrared (IR) interface, a radio frequency (RF) interface, and/or a universal serial bus (USB) interface.

The network interface 306 may be used to enable the server 300 to communicate on a network, such as the Internet, the data network 105, the enterprise, and the like, etc. The network interface 306 may include, for example, an Ethernet card or adapter (e.g., 10BaseT, Fast Ethernet, Gigabit Ethernet, 10 GbE) or a wireless local area network (WLAN) card or adapter (e.g., 802.11a/b/g/n). The network interface 306 may include address, control, and/or data connections to enable appropriate communications on the network. A data store 308 may be used to store data.

The data store 308 is a type of memory and may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 308 may incorporate electronic, magnetic, optical, and/or other types of storage media. In one example, the data store 308 may be located internal to the server 300 such as, for example, an internal hard drive connected to the local interface 312 in the server 300. Additionally in another embodiment, the data store 308 may be located external to the server 300 such as, for example, an external hard drive connected to the I/O interfaces 304 (e.g., SCSI or USB connection). In a further embodiment, the data store 308 may be connected to the server 300 through a network, such as, for example, a network attached file server.

The memory 310 may include any of volatile memory elements (e.g., random access memory (RAM, such as DRAM, SRAM, SDRAM, etc.)), nonvolatile memory elements (e.g., ROM, hard drive, tape, CDROM, etc.), and combinations thereof. Moreover, the memory 310 may incorporate electronic, magnetic, optical, and/or other types of storage media. Note that the memory 310 may have a distributed architecture, where various components are situated remotely from one another, but can be accessed by the processor 302. The software in memory 310 may include one or more software programs, each of which includes an ordered listing of executable instructions for implementing logical functions. The software in the memory 310 may include a suitable operating system (O/S) 314 and one or more programs 316.

The operating system 314 essentially controls the execution of other computer programs, such as the one or more programs 316, and provides scheduling, input-output control, file and data management, memory management, and communication control and related services. The operating system 314 may be, for example Windows NT, Windows 2000, Windows XP, Windows Vista, Windows 7, Windows 8, Windows 10, Windows Server 2003/2008 (all available from Microsoft, Corp. of Redmond, Wash.), Solaris (available from Sun Microsystems, Inc. of Palo Alto, Calif.), LINUX (or another UNIX variant) (available from Red Hat of Raleigh, N.C. and various other vendors), Android and variants thereof (available from Google, Inc. of Mountain View, Calif.), Apple OS X and variants thereof (available from Apple, Inc. of Cupertino, Calif.), or the like.

The one or more programs 316, such as a system management module 317 (FIG. 7), may be configured to implement the various processes, algorithms, methods, techniques, etc. described herein and to read, write, access or otherwise manipulate data in a database, such as a system database 110 (FIG. 7) of the system 100.

Referring to FIG. 6, in an exemplary embodiment, a block diagram illustrates a client device 400 of which one or more may be used in the system 100 or the like and which may be a type of computing platform. The client device 400 can be a digital device that, in terms of hardware architecture, generally includes a processor 402, input/output (I/O) interfaces 404, a radio 406, a data store 408, and memory 410. It should be appreciated by those of ordinary skill in the art that FIG. 6 depicts the client device 400 in an oversimplified manner, and a practical embodiment may include additional components and suitably configured processing logic to support known or conventional operating features that are not described in detail herein. The components (402, 404, 406, 408, and 410) are communicatively coupled via a local interface 412. The local interface 412 can be, for example but not limited to, one or more buses or other wired or wireless connections, as is known in the art. The local interface 412 can have additional elements, which are omitted for simplicity, such as controllers, buffers (caches), drivers, repeaters, and receivers, among many others, to enable communications. Further, the local interface 412 may include address, control, and/or data connections to enable appropriate communications among the aforementioned components.

The processor 402 is a hardware device for executing software instructions. The processor 402 can be any custom made or commercially available processor, a central processing unit (CPU), an auxiliary processor among several processors associated with the client device 400, a semiconductor-based microprocessor (in the form of a microchip or chip set), or generally any device for executing software instructions. When the client device 400 is in operation, the processor 402 is configured to execute software stored within the memory 410, to communicate data to and from the memory 410, and to generally control operations of the client device 400 pursuant to the software instructions. In an exemplary embodiment, the processor 402 may include a mobile optimized processor such as optimized for power consumption and mobile applications.

The I/O interfaces 404 can be used to receive data and user input and/or for providing system output. User input can be provided via a plurality of I/O interfaces 404, such as a keypad, a touch screen, a camera, a microphone, a scroll ball, a scroll bar, buttons, bar code scanner, voice recognition, eye gesture, and the like. System output can be provided via a display screen 404A such as a liquid crystal display (LCD), touch screen, and the like. The I/O interfaces 404 can also include, for example, a global positioning service (GPS) radio, a serial port, a parallel port, a small computer system interface (SCSI), an infrared (IR) interface, a radio frequency (RF) interface, a universal serial bus (USB) interface, and the like. The I/O interfaces 404 can include a graphical user interface (GUI) that enables a user to interact with the client device 400. Additionally, the I/O interfaces 404 may be used to output notifications to a user and can include a speaker or other sound emitting device configured to emit audio notifications, a vibrational device configured to vibrate, shake, or produce any other series of rapid and repeated movements to produce haptic notifications, and/or a light emitting diode (LED) or other light emitting element which may be configured to illuminate to provide a visual notification.

The radio 406 enables wireless communication to an external access device or network. Any number of suitable wireless data communication protocols, techniques, or methodologies can be supported by the radio 406, including, without limitation: RF; IrDA (infrared); Bluetooth; ZigBee (and other variants of the IEEE 802.15 protocol); IEEE 802.11 (any variation); IEEE 802.16 (WiMAX or any other variation); Direct Sequence Spread Spectrum; Frequency Hopping Spread Spectrum; Long Term Evolution (LTE); cellular/wireless/cordless telecommunication protocols (e.g. 3G/4G, etc.); wireless home network communication protocols; paging network protocols; magnetic induction; satellite data communication protocols; wireless hospital or health care facility network protocols such as those operating in the WMTS bands; GPRS; proprietary wireless data communication protocols such as variants of Wireless USB; and any other protocols for wireless communication.

The data store 408 may be used to store data and is therefore a type of memory. The data store 408 may include any of volatile memory elements (e.g., random access memory (RAM, such as DRAM, SRAM, SDRAM, and the like)), nonvolatile memory elements (e.g., ROM, hard drive, tape, CDROM, and the like), and combinations thereof. Moreover, the data store 408 may incorporate electronic, magnetic, optical, and/or other types of storage media.

The memory 410 may include any of volatile memory elements (e.g., random access memory (RAM, such as DRAM, SRAM, SDRAM, etc.)), nonvolatile memory elements (e.g., ROM, hard drive, etc.), and combinations thereof. Moreover, the memory 410 may incorporate electronic, magnetic, optical, and/or other types of storage media. Note that the memory 410 may have a distributed architecture, where various components are situated remotely from one another, but can be accessed by the processor 402. The software in memory 410 can include one or more software programs 416, each of which includes an ordered listing of executable instructions for implementing logical functions. In the example of FIG. 6, the software in the memory system 410 includes a suitable operating system (O/S) 414 and programs 416.

The operating system 414 essentially controls the execution of other computer programs, and provides scheduling, input-output control, file and data management, memory management, and communication control and related services. The operating system 414 may be, for example, LINUX (or another UNIX variant), Android (available from Google), Symbian OS, Microsoft Windows CE, Microsoft Windows 7 Mobile, Microsoft Windows 10, iOS (available from Apple, Inc.), webOS (available from Hewlett Packard), Blackberry OS (Available from Research in Motion), and the like.

The programs 416 may include an interface module 417 (FIG. 7) and various applications, add-ons, etc. configured to provide end user functionality with the client device 400. Exemplary programs 417 may include, but not limited to, a web browser, social networking applications, streaming media applications, games, mapping and location applications, electronic mail applications, financial applications, and the like. In a typical example, the end user typically uses one or more of the programs 416, such as an interface module 417, along with a network 105 and a wireless electronic connection 106 to manipulate information of the system 100.

FIG. 7 depicts a block diagram illustrating some modules of a electronic fuel management control and accounting system 100 which may function as software rules engines according to various embodiments described herein. In some embodiments, the system 100 may comprise a dispensing module 59, a system management module 317, and an interface module 417. One or more of the modules 59, 317, 417, may optionally be configured to run on a dispenser control device 50, a server 300 and/or a client device 400.

The one or more dispenser control devices 50, servers 300, and client devices 400 may be in wired and/or wireless electronic communication through a network 105 with a data store 308 comprising a database, such as a system database 110. The modules 59, 317, 417, may read, write, or otherwise access data in one or more databases and system databases 110 of the data store 308.

In this and some embodiments, one or more servers 300 may be configured to run one or more software rules engines or programs such as a system management module 317, one or more dispenser control devices 50 may be configured to run one or more software rules engines or programs such as a dispensing module 59, while one or more client devices 400 may be configured to run one or more software rules engines or programs such as an interface module 417. In other embodiments, a system management module 317, dispensing module 59, and/or interface module 417 may be configured to run on one or more dispenser control devices 50, client devices 400, and/or servers 300 with data transferred to and from one or more servers 300 in communication with a data store 308 through a network 105. In still further embodiments, a dispenser control device 50, a server 300, or a client device 400 may be configured to run a system management module 317, dispensing module 59, and/or interface module 417. It should be understood that the functions attributed to the modules 59, 317, 417, described herein are exemplary in nature, and that in alternative embodiments, any function attributed to any modules 59, 317, 417, may be performed by one or more other modules 59, 317, 417, or any other suitable processor logic.

In some embodiments, the system management module 317 may comprise or function as management logic stored in a memory 310 which may be executable by the processor 302 of a server 300. The system management module 317 may send and receive data with one or more client devices 400, other servers 300, and/or dispenser control devices 50. The system management module 317 may also read, write, edit, create, import, export, and delete data and information within the system database 110. For example, the system management module 317 may store data describing the amounts of material dispensed by one or more material providing systems 11 having a dispenser control device 50 to one or more users 101 and also may handle authorization of a user 101 to receive material via a material providing system 11 having a dispenser control device 50.

In some embodiments, the interface module 417 may comprise or function as interface logic stored in a memory 410 which may be executable by the processor 402 of a client device 400. The interface module 417 may control a display type I/O interface 404, such as a touch screen, of a client device 400 to output data from the system 100 to the user 101 and to input data provided by the user 101 to the system 100. For example, the interface module 417 may receive input from a user 101 describing the user 101 or a vehicle of the user 101 and also display or output authorization information for a material providing system 11 having a dispenser control device 50 to a user 101 that is proximate to the material providing system 11.

Additionally, the interface module 417 may enable data to be exchanged between a server 300 and a dispenser control device 50 using the network connection 104 between the server 300 and client device 400 and also using the wireless electronic connection 106 (FIGS. 1 and 7) between the client device 400 and the dispenser control device 50. In further embodiments, the interface module 417 of the client device 400 may communicate with the dispensing module 59 of the dispenser control device 50 thereby allowing the interface module 417 to control dispensing of the material from the material providing system 11. In still further embodiments, the interface module 417 may provide data that describes the quantity of material dispensed by the material providing system 11 to a system management module 317 of a server 300.

In some embodiments, the dispensing module 59 may comprise or function as dispensing logic stored in a memory 55 which may be executable by the processor 51 of a dispenser control device 50. The dispensing module 59 may send and receive data with one or more client devices 400, servers 300, material providing systems 11, and/or tank level probes 19. Preferably, the tank level probe 19 may provide data describing the level of material in a tank 10 accessed by the material providing system 11 to the dispensing module 59. Additionally, the dispensing module 59 may control one or more functions of a material providing system 11 and/or tank level probe 19. For example, the dispensing module 59 may receive data from a client device 400 and/or server 300 enabling or declining the dispensing of a material from a material providing system 11 and then use the data to enable or decline the material providing system 11 to dispense the material. In further embodiments, the dispensing logic 59 may communicate with the system management module 317 of the server 300 via the interface module 417 logic of the client device 400 thereby allowing the system management module 317 to control dispensing of the material from the material providing system 11. In still further embodiments, the dispensing logic 59 may control the material motivator 21 via the pump control relay 62. In further embodiments, the dispensing logic 59 may provide data describing the level of material in a tank 10 of a material providing system 11 to the system management module 317 of the server 300 via the interface module 417 through the network connection 104 of the client device 400.

In some embodiments, the system 100 may comprise one or more databases, such as a system database 110, optionally stored on a data store 308, 408, 54, of one or more servers 300, dispenser control devices 50, and/or client devices 400 accessible to a system management module 317, an interface module 417, and/or a dispensing module 59. A system database 110 may comprise any data and information input to and output by the system 100. This data may include information describing a user 101, information describing a vehicle or other material receiving object, financial or transactional information, such as credit/debit card information, fleet fuel card information, and the like, amounts of material dispensed to each user 101, amounts of material dispensed by each material providing system 11 having a dispenser control device 50, and or any other information.

Figure 8:
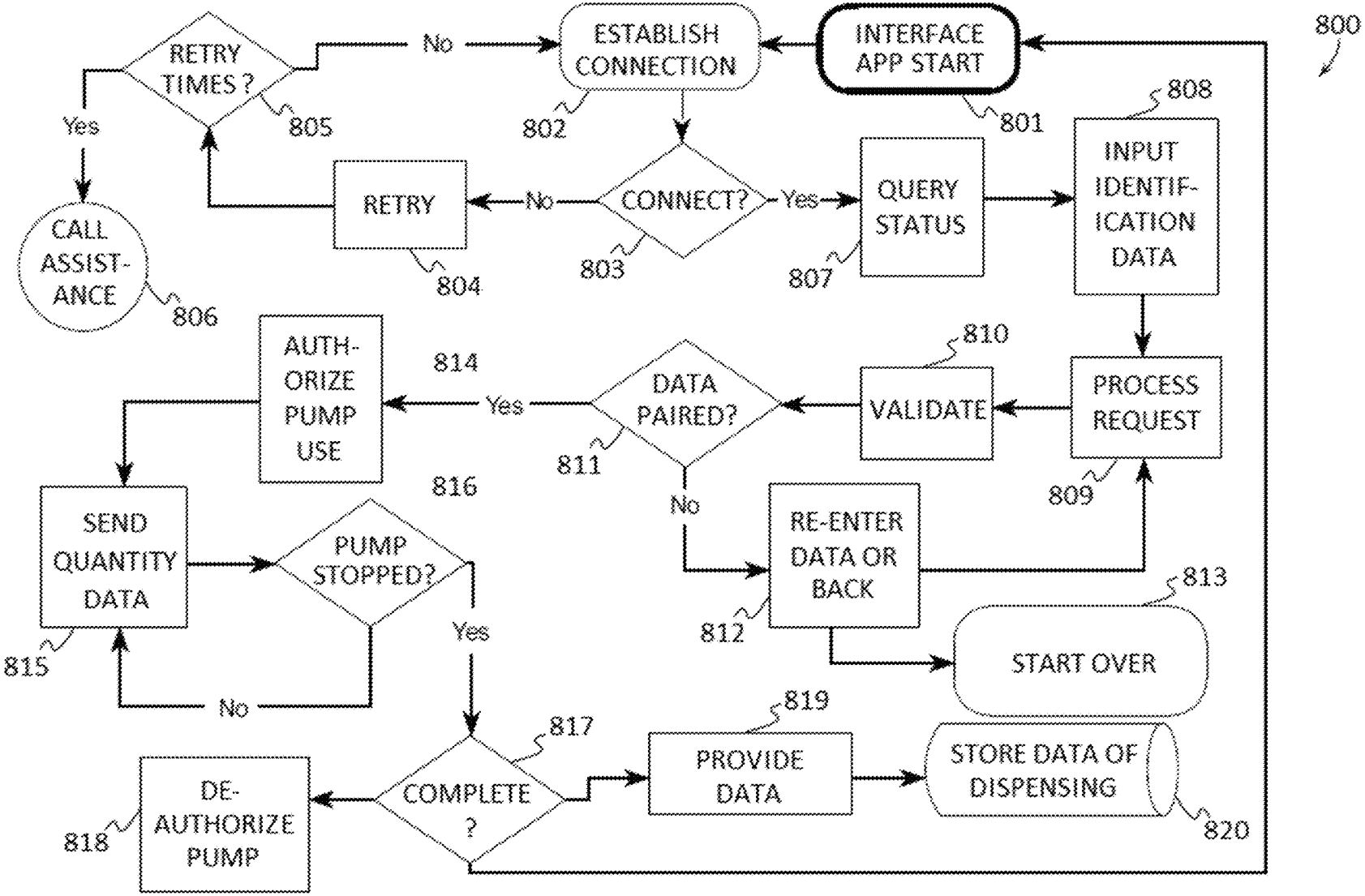
FIG. 8 illustrates a block diagram of an example of a computer-implemented method for dispensing a material according to various embodiments described herein.

FIG. 8 illustrates a block diagram of an example of a computer-implemented method for dispensing a material ("the method") 800 according to various embodiments described herein. Referring now to FIGS. 1-4, 7, and 8, in some embodiments, the method 800 may begin and the interface module 417 may be started 801, initiated, or accessed on the client device 400 of a user 101. Optionally, the interface module 417 may be started or initiated by user 101 input and/or input provided from a dispenser control device 50.

Initiation of the interface module 417 may cause the interface module 417 to query a dispenser control device 50 in communication with a material providing system 11 that is proximate to the client device 400 for a valid wireless electronic connection 106 to establish a data connection in step 802. Next in decision block 803, The logic tree point 45 may continue to step 804 if the interface module 417 is unsuccessful at establishing a wireless electronic connection 106 where it may try again to establish a wireless electronic connection 106. Optionally, the method 800 may continue to decision block 805 where the interface module 417 may try a number of times, such as three times, to establish a connection. If the interface module 417 is unable to establish a wireless electronic connection 106, the method 800 may continue to step 806 and the interface module 417 may call or otherwise attempt to contact for assistance.

If the interface module 417 is successful in establishing a connection with the dispensing module 59 of the dispenser control device 50, the interface module 417 may query the dispensing module 59 for the status of its dispenser control device 50 in step 807. A successful query response back to the client device 400 may allow the user to proceed to input identification data into the client device 400 requested data in step 808, such as vehicle identification (ID), user ID, odometer reading or any other information as the interface module 417 and/or requests dispensing module 59. The input data may transmitted via a cell or other data network to the system management module 317 of the server 300.

In step 809, the system management module 317 may processes the input data or fueling request from the client device 400. The system management module 317 may validate the input data in step 810 along with any other data in the system database 110, such as any vehicle associated data such as odometer, time and date, allowable fuel types, locations authorized to fuel and other applicable constraints determine if it is indeed allowed to proceed with fueling. Next, in decision block 811, the system management module 317 may determine if the input identification data paired or matches with data in the system database 110. If the data does not pair, the method 800 may continue to step 812 to re-enter data or go back, and from step 812 to step 809 to process the re-entered data or to step 813 to start over or the transaction is terminated.

The method may proceed from decision block 811 to step 814 if the system management module 317 determines that the input identification data paired or matches with data in the system database 110 and the system management module 317 may communicate with the dispensing module 59 to authorize use of the pump or material providing system 11. In some embodiments, the content of the authorization signal may be configurable from a simple go/no-go to additional data content containing information entered at the data entry point used in step 808. The user 101 may then operate the pump or material providing system 11 to dispense a quantity of material, optionally a quantity dictated by the system management module 317, and the method 800 may proceed to step 815 in which the dispensing module 59 may send data describing the quantity of material dispensed to the system management module 317 and/or the interface module 417.

The method 800 may then proceed from step 815 to decision block 816 and the dispensing module 59 may determine if the dispensing of material has stopped, such as by detecting if the pump or material providing system 11 has stopped. If it has not stopped, the method may continue to step 815. If the pump or material providing system 11 has stopped, the method 800 may proceed to decision block 817.

At decision block 817, the dispensing module 59 and/or system management module 317 may determine if the transaction has completed, such as by the user 101 shutting off the pump or the like. Once it has been determined that the transaction has completed, the method may continue to both steps 818 and 819. In step 818, the dispensing module 59 and/or system management module 317 may de-authorize the pump to prevent further dispensing of material. In step 819, the dispensing module 59 may send or provide transaction data describing the dispensing of the material to the system management module 317 and/or to the interface module 417. Next in step 820 the system management module 317 may store the data describing the dispensing of the material that was provided in step 819 into the system database 110 where it may be accessed by one or more other users 101 via their respective client device 400 and the method 800 may finish.

In some embodiments of the method 800, receipt of more detailed information by the dispensing module 59, such as from the material providing system 11 or interface module 417 allows the dispensing module 59 to act as a backup storage device for completed transactions as all transaction data including total amount pumped is also retained within the data store 54 of the dispensing module 59. If there is a system failure of any part of the data transmission for a prior competed transaction, then the dispensing module 59 has the capability to re-transmit the prior transaction back to the system management module 317 and/or interface module 417 thereby allowing a completed but non transmitted prior transaction to also be sent to piggyback onto the current transaction from data point in step 819.

In some embodiments of the method 800, once the dispensing module 59 and the pump or material providing system 11 is authorized at step 814, the dispensing module 59 may turn on a pump control relay 62 allowing electrical power to flow to the dispenser pump motor of the material providing system 11, and the dispensing module 59 may receive quantity pulses from pulser 13. The dispensing module 59 may send increasing quantity data, to the client device 400 via WiFi or other wireless electronic connection 106. In further embodiments, at decision block 816, the dispensing module 59 allows fueling to continue with fueling quantity increasing and once the quantity has stopped the transaction is considered finished or completed in step 817. At this point the completed transaction data may optionally be sent via the network connection 104 of the client device 400 as directed by the interface module 417 to the system management module 317, at which time the data may be processed and stored in the system database 110. The data may be now available via web based browser equipped remote client device 400 for any user 101, and preferably a user 101 authorized via providing login or other system credentials, to view, manipulate, sort, download and print from the user's 101 respective client device 400.

Figure 9:
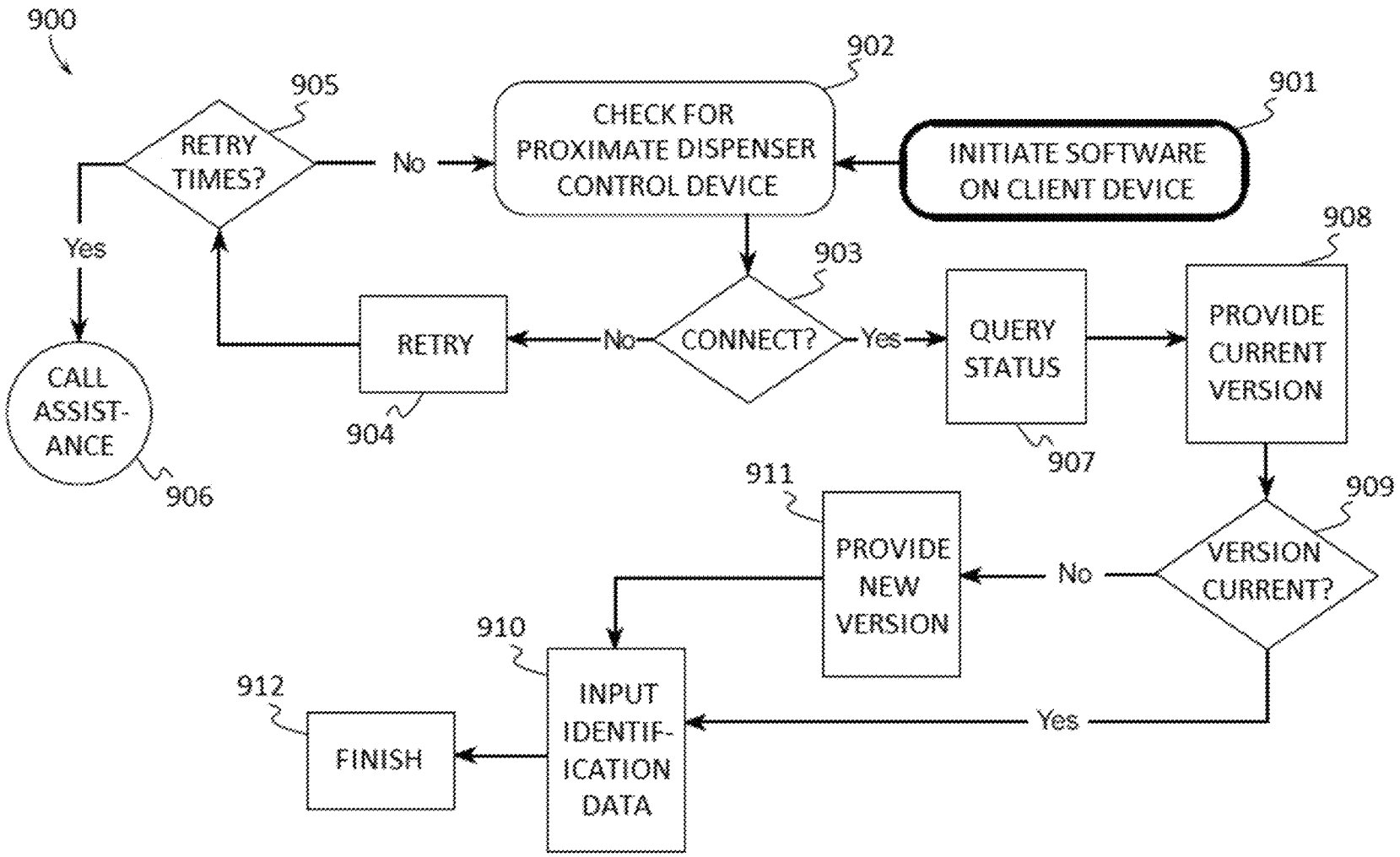
FIG. 9 shows a block diagram of an example of a computer-implemented method for updating one or more software rules engines of a dispenser control device according to various embodiments described herein.

FIG. 9 shows a block diagram of an example of a computer-implemented method for updating one or more software rules engines of a dispenser control device 50 ("the method") 900 according to various embodiments described herein. Referring now to FIGS. 1-4, 7, and 9, the method 900 may be performed by the system 100 to allow for periodic updating of the software programs 58, such as a dispensing module 59, of a dispenser control device 50 using the network connection 104 of a client device 400 having a wireless electronic connection 106 with the dispenser control device 50. In preferred embodiments, the method 900 may be used to provide a dispensing module 59 to the dispenser control device 50 by the system management module 317 of the server 300 via the interface module 417 of a client device 400 through the network connection 104 of the client device 400.

In some embodiments, the method 900 may begin and the interface module 417 may be initiated or resumed on a client device 400 in step 901. Next in step 902, the interface module 417 may attempt to establish a wireless electronic connection 106 with a dispenser control device 50 that is proximate or in wireless communication range with the client device 400 that is running the interface module 417. The method 900 may continue to decision block 903 and the interface module 417 may determine if a wireless electronic connection 106 is established with a dispensing module 59 of a proximate dispenser control device 50. If the interface module 417 is not able to establish wireless electronic connection 106 with a dispenser control device 50, the interface module 417 may determine that it is not connected and proceed to step 904 and the interface module 417 may try again to establish a wireless electronic connection 106. Optionally, the method 900 may continue to decision block 905 where the interface module 417 may try a number of times, such as three times, to establish a connection. If the interface module 417 is unable to establish a wireless electronic connection 106, the method 900 may continue to step 906 and the interface module 417 may call or otherwise attempt to contact for assistance.

If the interface module 417 is able to establish wireless electronic connection 106 with a dispenser control device 50, the interface module 417 may determine that it is connected and proceed from decision block 903 to step 907. In step 907, the interface module 417 may query the dispensing module 59 of the dispenser control device 50 for status information which may include information describing the dispenser control device 50, such as the current software or firmware version of the dispensing module 59, and optionally information describing the material providing system 11 to which the dispenser control device 50 is communicatively coupled to.

In step 908, the dispensing module 59 may communicate the status information of the dispenser control device 50 to the interface module 417 by way of the wireless electronic connection 106, and the interface module 417 may communicate the status information of the dispenser control device 50 to the system management module 317 by way of the network connection 104 of the client device 400.

At decision block 909, the system management module 317 may determine if the dispenser control device 50 is running the current version of the dispensing module 59 such as by comparing the communicated status information to information in the system database 110. If the system management module 317 determines that the dispenser control device 50 is running the current version of the dispensing module 59, the method 900 may proceed to step 910 and identification data may be input to the system via the interface module 417 of the client device 400. Preferably, step 910 of the method 900 may be or function as step 808 of method 800 shown in FIG. 8 and the method 900 may finish 912.

If the system management module 317 determines that the dispenser control device 50 is not running the current version of the dispensing module 59, the method 900 may proceed to step 911 and the system management module 317 may provide the current version of the dispensing module 59 to the dispenser control device 50 via the network connection 104 of the client device 400 and the wireless electronic connection 106 thereby enabling the dispenser control device 50 to be updated to the current version of the dispensing module 59. The method 900 may then proceed to step 910, and the method 900 may finish 912.

While some materials have been provided, in other embodiments, the elements that comprise the dispenser control device 50 such as the housing 18, optional first housing 18A, optional second housing 18B, optional tank level probe 19, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the dispenser control device 50 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the dispenser control device 50 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the dispenser control device 50 may be coupled by being one of connected to and integrally formed with another element of the dispenser control device 50.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. An electronic fuel management control and accounting system, the system comprising:

a network-connected dispenser control device housed in an explosion proof housing, the dispenser control device comprising a memory a processor, and programming instructions, the programming instructions when executed by the processor cause the processor to:

communicatively connect to a material providing system to dispense fuel;

communicatively connect to a portable electronic device;

receive authorization from the portable electronic device;

communicate with management logic of a server via the portable electronic device thereby allowing the management logic from the server to authorize dispensing of the fuel from the material providing system using the portable electronic device as a communication bridge to facilitate communication between the dispenser control device and the server;

connect to one or more light emitting diode indicator elements;

wherein the explosion proof housing comprises a metal tubular first housing and a clear plastic second housing, the clear plastic second housing comprising the one or more light emitting diode indicator elements to provide user feedback;

wherein the explosion proof housing is sealed from outside explosive vapors and sealed from the clear plastic second housing.

2. The system of claim 1, wherein the dispenser control device is in wireless communication with the server via wireless communication between the portable electronic device and the server and wherein the server is not in direct communication with the dispenser.

3. The system of claim 1, wherein the dispenser control device comprises a pulser interface for receiving data from a pulser communicatively coupled to the material providing system that describes a quantity of fuel dispensed by the material providing system.

4. The system of claim 3, wherein the data from the pulser is stored in a system database accessible to the server.

5. The system of claim 3, wherein the data from the pulser is stored in a system database accessible to the portable electronic device and to the server.

6. The system of claim 1, further comprising a pump control relay communicatively coupled to a material motivator of the material providing system, and wherein the dispensing logic controls the material motivator via the pump control relay.

7. The system of claim 1, further comprising a tank level probe wirelessly connected to the dispenser control device, and wherein the tank level probe provides data describing a level of fuel in a tank accessed by the material providing system to the dispensing logic.

8. The system of claim 7, wherein the dispensing logic provides data describing the level of fuel in the tank to the management logic of the server via the interface logic of the portable electronic device so that the portable electronic device facilitates a transfer of fuel level data from the dispenser control device to the server.

9. The system of claim 1, wherein the portable electronic device transmits a vehicle identification (ID) to the server via the wireless network and the management logic of the server processes and validates the vehicle identification (ID) and transmits via the wireless network and authorization to the portable electronic device.

10. The system of claim 9, wherein the authorization is received by the portable electronic device and the portable electronic device wirelessly transmits a dispensing authorization to the dispenser control device to authorize use of the material providing system.

11. The system of claim 9, further comprising a puller configured to measure and communicate a quantity of data of dispensed fuel where the quantity of data of dispensed fuel is transmitted wirelessly to the server through the interface logic of the portable electronic device and wherein the management logic of the server records the quantity data of the dispensed fuel in a data store record associated with the vehicle identification (ID).

12. The system of claim 1, further comprising a pre-authorization mode, the pre-authorization mode comprising the steps of:

sending a pre-authorization message from the server to the portable electronic device while the portable electronic device is within network range of the server but not yet within network range of the dispenser control device; and the portable client device providing authorization to the dispenser control device upon entering into network range with the dispenser control device thereby allowing the management logic of the server to still provide authorization for a dispensing of fuel when both the dispenser control device and the portable electronic device are not able to communicate with the server.

13. The system of claim 12, further comprising the step of storing a final transaction within the portable electronic device until such time as the portable electronic device returns back to network range and is able to communicate with the server.

* * * * *